United States Patent [19]

Cocks

[11] Patent Number: 4,457,258

[45] Date of Patent: Jul. 3, 1984

[54] MARKING APPARATUS FOR PAINTS AND INKS

[76] Inventor: Eric H. Cocks, 6788 NW. Seventeenth Ave., Ft. Lauderdale, Fla. 33309

[21] Appl. No.: 455,591

[22] Filed: Jan. 4, 1983

[51] Int. Cl.[3] ..... B05C 3/109

[52] U.S. Cl. ..... 118/694; 118/698; 118/DIG. 21; 118/325; 118/323; 118/612; 239/112; 239/304

[58] Field of Search ..... 118/694, 698, DIG. 21, 118/325, 323, 612; 174/112; 118/302; 222/226; 239/112, 304

[56] References Cited

U.S. PATENT DOCUMENTS

| | | | |
|---|---|---|---|
| 2,428,284 | 9/1947 | Krogel | 118/DIG. 21 |
| 2,875,094 | 2/1959 | Bloem | 118/612 |
| 2,981,225 | 4/1961 | Vatt | 118/DIG. 21 |
| 3,343,981 | 9/1967 | Lenkei | 118/325 |
| 3,738,312 | 6/1973 | Padjen | 118/694 |
| 3,892,197 | 7/1975 | Kinney | 118/7 |
| 3,903,840 | 9/1975 | Gemelli | 118/DIG. 21 |
| 4,376,512 | 3/1983 | Kistner | 239/304 |

*Primary Examiner*—Norman Morgenstern
*Assistant Examiner*—James J. Seidleck
*Attorney, Agent, or Firm*—Crickenberger & Moore

[57] ABSTRACT

A marking apparatus comprises a plurality of containers of colored inks and a solvent connected to a mixing chamber and a rotating applicator. Insulated wire is marked by passing it through the applicator housing which collects the excess colored ink. The excess ink may be returned selectively to either the mixing chamber or a disposal container. Solvent purging of the system permits rapid changeover of colors.

3 Claims, 1 Drawing Figure

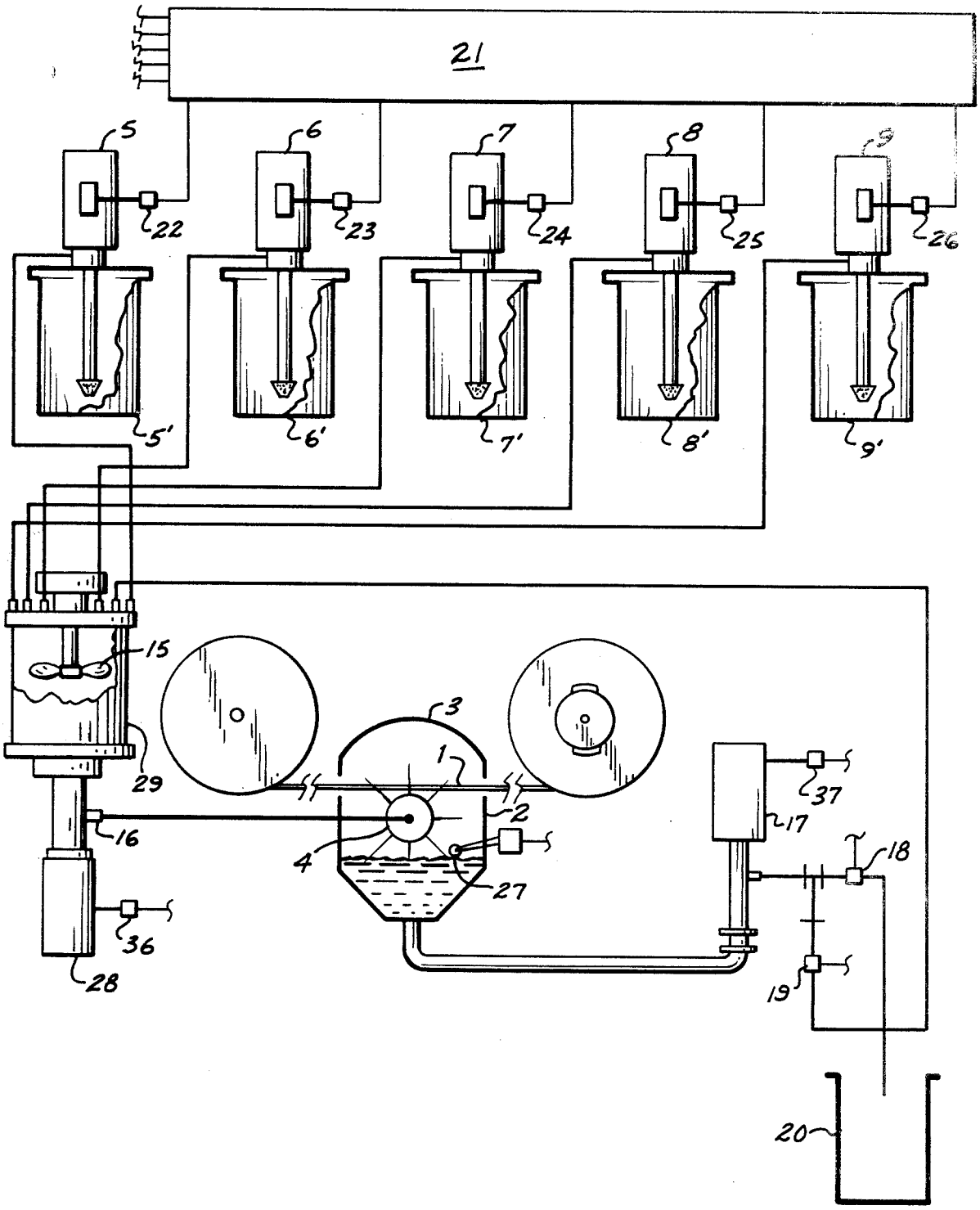
21
5
6
7
8
9
22
23
24
25
26
5'
6'
7'
8'
9'
15
29
3
1
2
4
27
16
36
28
37
17
18
19
20

MARKING APPARATUS FOR PAINTS AND INKS

BACKGROUND OF THE INVENTION

In production line operations in various industries there is the need to apply colored inks, paints, and the like, for marking purposes, where it is of prime importance that the minimum of time elapse when changing from one color to another. The color being used is intended mainly for identification purposes, and the fact that a color may be somewhat off-shade is not critical, as long as it can be recognized.

A typical example is the application of ink to the outside of insulated wire. A wire with a white colored insulation may have applied to it various colored markings so that it can be identified for ease in wiring and troubleshooting purposes. Some wire may be marked with red dots or lines, some with blue, some with blue and red, etc. One practice in marking such wire, is to apply ink from a rotating nozzle or wheel-type applicator which throws ink on the wire as it passes through an enclosure. This ink is applied from a pressure container or pump, and discharged to atmosphere in proximity to the wire, with ink which does not adhere to the wire being reclaimed and re-circulated to the supply tank, saved for future use, or discarded.

If a red ink is being applied and the time arrives where it is required to switch to a new color ink, the operator must cut off the supply of red ink, use a solvent to purge the red ink remaining in the system to insure that there will not be sufficient residue of the red ink left to influence the new color to the point where it would not be readily recognized, and then connect the new color to the system and start running. This is a time-consuming process requiring many minutes for the skillful operator and sometimes, without the assurance that adequate cleaning has been achieved. During this color changeover time, the wire may have been running at 5,000 feet per minute, and indiscriminate marking would have been applied while the color change was in progress. This wire, in many cases, would have to be discarded or used as seconds. Furthermore, there is a time-consuming requirement insofar that the improperly marked wire must be unrolled to remove it from the production line.

SUMMARY OF THE INVENTION

The present invention relates to an insulated wire marking apparatus which utilizes a number of containers of primary and major coloring, such as inks.

Each container includes a supply pump to deliver the ink under pressure to a mixing chamber. From the mixing chamber the ink is carried by a feed pump to the point of application, where the ink is applied to the insulated wire on the outer surface of the insulation. The excess ink falls away from the wire into a collecting chamber which is designed to drain into the inlet of a discharge pump. The discharge pump is fitted with two valves so that its output can be diverted either to a waste collection area or returned to the mixing chamber.

Through a suitable control system, the excess ink is returned to the mixing chamber where it continues to be reused. The operation of the discharge pump from the collection chamber is controlled by level controls. The pressures of the various pumps are adjusted to suit the requirements of the system and to eliminate back pressures that would force the fluid into any unwanted passages. When it is required to change colors, the control system immediately stops the flow from the supply tanks to the mixing chamber, and connects solvent to this chamber and diverts the output from the discharge pump to the waste area. The solvent forces the remaining ink through the system and into the discharge area. The situation continues for sufficient time to insure that the ink has passed through the system and that there is no ink within the system as far as the discharge pump.

When the system has been substantially purged of ink, the outlet from the discharge pump is diverted from the waste system to the mixing chamber. An agitator within the mixing chamber continues to run, and the feed pump forces the material through a closed circuit being agitated by the built-in agitator so that the solvent effectively cleans all of the inside areas. This operation is allowed to continue for a few seconds, and then the control system again operates the valve to divert the contaminated solvent to the discharge area and inject fresh solvent into the closed system.

When sufficient cleaning has been carried out, the solvent flow is shut off, and the required new colors are selected. The control system diverts the solvent in the system to the waste area until it is assured that the colors are available for operation. The control system then sets the various valves and pumps so that the new colors are passed through the system.

BRIEF DESCRIPTION OF DRAWING

The drawing is a general diagram showing typical parts of the system.

DESCRIPTION OF THE PREFERRED EMBODIMENTS

The drawing illustrates a typical system to be used in applying ink, for marking purposes, to insulated wire.

The insulated wire is shown traveling in a horizontal position for the purpose of being marked. It is carried through a housing 2 which encloses a pressure-fed rotating applicator 4. The rotating applicator has a number of small holes drilled around its periphery so that fluid forced through the center is ejected through the holes. The applicator 4 is positioned in relationship to the wire 1 and driven at a speed so that as ink is ejected from the holes close to the wire, the ink adheres to and marks the wire. Excess ink falls into housing 2 for further collection.

Air-operated double-acting pumps 5 through 9 are mounted on containers 5' through 9', respectively. Double-acting pump 28 is coupled to mixing chamber 29 which is located in proximity to the housing 2 for the convenience of the operator. An agitator 15 is located in mixing chamber 29 to mix thoroughly the various colored liquids, and to insure a thorough cleaning action when solvent is injected into the system. The outlet 16 from double-acting pump 28 is connected to the pressure fed rotating applicator 4, which applies the colored fluids to insulated wire 1.

A double-acting discharge pump 17 is connected to the collecting trough portion of housing 2 and is operated by liquid level switch 27. The outlet from double-acting discharge pump 17 has bifurcated lines controlled by solenoid valves 18 and 19, which divert the fluid into disposal tank 20 and mixing chamber 29, respectively.

The solenoid valves used throughout the system are air valves, all of which are operated from a control station 21, which is shown diagramatically. The details of the control system are not shown, since its operation is straightforward and does not form a part of the present invention, other than as an element of the system.

In operation, a wire 1 of suitable size is passed through housing 2 which has a cover 3 to collect overspray so that the excess colored liquid is collected in the trough bottom of housing 2. For the purpose of description, it will be assumed that containers 5', 6', 7', 8', and 9' are filled, respectively, with red ink, yellow ink, blue ink, solvent, and white ink. If it is assumed that red ink is the first color to be applied, solenoid valve 36 operates double-acting pump 28 to draw fluid from the mixing chamber 29 and force it into pressure-fed rotating applicator 4, causing insulated wire 1 to be coated with red ink as it is ejected from the applicator 4. The excess red ink is collected at the bottom of housing 2, and when it reaches a sufficient height, it operates liquid level switch 27, which, in turn, operates solenoid valve 37 to activate double-acting discharge pump 17 and draw the excess fluid from housing 2. At this time, solenoid valve 18 is closed and solenoid valve 19 is open so that the red ink discharged will be returned back to mixing chamber 29 where it will again be passed through the system so long as red ink is called for. Appropriate check valves are provided throughout the system to prevent feedback of materials, as is well known in the art.

When the operator is required to shut off the supply of red ink and select a new color, the control system will turn off solenoid valve 22, thereby stopping double-acting pump 5 from supplying red ink. Solenoid valve 19 will close, thereby shutting off the feedback of red ink to mixing chamber 29 and solenoid valve 18 will open, thereby diverting the red ink into the disposal tank. Solenoid valve 25 will open to operate double-acting pump 8, thereby forcing solvent into the mixing chamber. Double-acting pumps 28 and 17 will continue to operate and the solvent will be pumped through the system to force the remaining red ink through the lines, the mixing chamber, and into the disposal tank.

When the system has been purged of red ink, solenoid valve 18 will close and solenoid valve 19 will open circulating the solvent from the discharge pump to the mixing chamber, where agitator 15 is operated. The agitator in the mixing chamber will cause all adhered paint to be washed off in preparation for the next color to be applied. After a sufficient time for agitation, valve 18 will again open and valve 19 will close, causing the solvent and red residue to be pumped into the disposal tank. The solvent cycle is repeated, and the system is then ready for the next color, which, for purposes of description, will be blue ink.

Solenoid valve 24 is operated to activate double-acting pump 7, which pumps blue ink into the mixing chamber 29. Double-acting pump 28 is activated, as is pump 17, and the blue ink forces any remaining solvent through solenoid valve 18 into the disposal tank, solenoid 19 being closed to prevent feedback into the mixing chamber 29. When the solvent has been purged and the lines filled with blue ink, solenoid valve 18 will close and valve 19 will open. The system is now ready to apply blue ink to the wire until changing to another color is required, at which time the operation is repeated to purge the system of blue ink and introduce the new color.

The system has been described using only one color at a time, but it will be appreciated that if the pumps are supplied with primary colors, the operator may simultaneously operate different pumps to provide predetermined mixtures to produce different colors. For example, the yellow and blue pump may operate together with the proper ratio to produce green ink in the mixing chamber. The only difference in operation to produce desired mixtures is that more than one supply pump will be operated at a time.

The double-acting pumps are provided with suitable controls so that the volume of ink delivered can be regulated, and in this fashion any desired color may be supplied. It will be apparent to those skilled in the art that while the system has been described in connection with the application of inks to insulated wire, the same system can be utilized to apply paint to a paint spray gun for use in any application where color changes are frequently required.

What is claimed is:

1. An insulated wire marking apparatus comprising a plurality of containers holding liquids of different colors;

a container holding a solvent for the liquids of different colors;

a mixing chamber;

means connecting the containers holding the liquids of different colors and the container holding the solvent to the mixing chamber;

agitator means located within the mixing chamber;

applicator means for applying the colored liquids to an insulated wire;

means connecting the mixing chamber to the applicator means;

a housing for the applicator means;

means for moving insulated wire past the applicator means through the housing;

a disposal tank;

discharge means for emptying the housing of excess liquid from the applicator means;

means selectively connecting the discharge means to either the disposal tank or the mixing chamber; and control means for operating the various means in selective order;

whereby a first desired color may be selected for application to the wire and the application of the first color may be discontinued and a second color applied with a minimum of elapsed time during the changeover period.

2. The combination according to claim 1 wherein the applicator means comprises a pressure-fed rotating member for ejecting colored liquid onto the insulated wire.

3. The combination according to claim 1 wherein the housing comprises a collecting trough portion having a liquid level switch mounted therein, said liquid level switch controlling the operation of the discharge means.

* * * * *